United States Patent [19]

MacAdam

[11] Patent Number: 4,680,433

[45] Date of Patent: Jul. 14, 1987

[54] CONTACT ASSEMBLY FOR A SWITCH

[75] Inventor: Donald H. MacAdam, Ancaster, Canada

[73] Assignee: Annulus Technical Industries, Inc., Ancaster, Canada

[21] Appl. No.: 816,822

[22] Filed: Jan. 7, 1986

[51] Int. Cl.[4] ..... H01H 1/12; H01H 15/06; H01H 21/76

[52] U.S. Cl. ..... 200/16 D; 200/8 R; 200/11 K; 200/6 C

[58] Field of Search ..... 200/8 R, 8 A, 11 G, 200/11 J, 11 K, 16 B, 16 C, 16 D, 276, 277, 6 C, 68.1

[56] References Cited

U.S. PATENT DOCUMENTS

| | | | |
|---|---|---|---|
| 2,037,730 | 4/1936 | Mason | 200/8 R |
| 2,384,652 | 9/1945 | Smith | 200/6 C |
| 2,467,758 | 4/1949 | Lindenblad | 200/11 R |
| 2,588,793 | 3/1952 | Barry | 200/8 R X |
| 3,226,496 | 12/1965 | Seabury, Jr. et al. | 200/8 R X |
| 3,259,727 | 7/1966 | Casler | 200/276 X |
| 3,311,717 | 3/1967 | Lace | 200/8 R |
| 3,546,402 | 12/1970 | Spaeth et al. | 200/16 D |
| 3,643,042 | 2/1972 | Gratz | 200/16 D |
| 4,016,401 | 4/1977 | Deaage | 200/277 |
| 4,031,345 | 6/1977 | Garcia | 200/67 AA |
| 4,034,177 | 7/1977 | Sims, Jr. | 200/277 X |
| 4,088,855 | 5/1978 | Emery | 200/276 X |
| 4,149,049 | 4/1979 | Long | 200/68.1 |

*Primary Examiner*—J. R. Scott
*Attorney, Agent, or Firm*—Brian W. Gray

[57] ABSTRACT

A contact assembly for a switch is provided which has an array of fixed surfaces, such as posts, which are arranged in a pattern such as points on a circumference and into which a conductive, elastic or resilient closed loop is seated under stress. The loop completes an electrical circuit through at least some of the fixed surfaces or posts and is moved in and out of the array by an actuator. A plurality of loops and a plurality of arrays may be provided.

17 Claims, 14 Drawing Figures

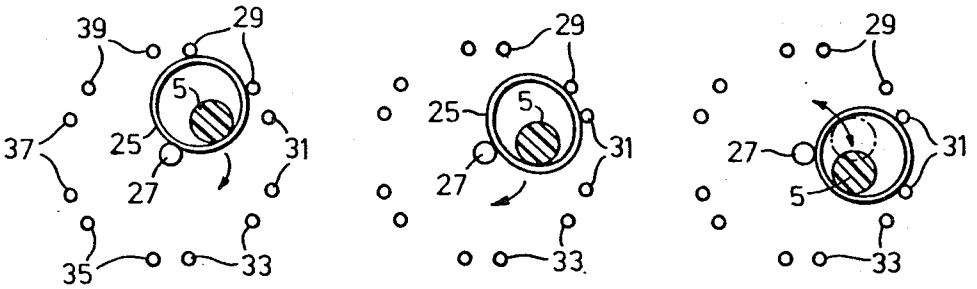
FIG. 4A
FIG. 4B
FIG. 4C
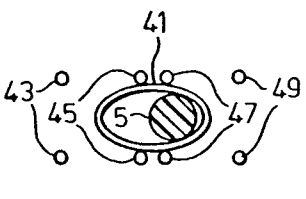
FIG. 5A
FIG. 5B
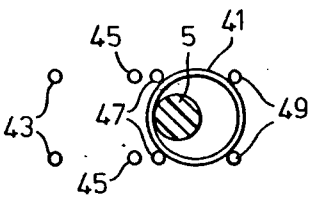
FIG. 5C

CONTACT ASSEMBLY FOR A SWITCH

FIELD OF THE INVENTION

This invention relates to the field of electrical and electronic switching mechanisms employing movable contacts, and specifically to those switching mechanisms which employ at least one stationary contact and at least one movable contact.

DESCRIPTION OF THE PRIOR ART

Electronic and electrical switches generally employ at the present time cam-actuated leaf spring contacts, butt contacts held under pressure by helical spring assemblies, or "snap-action" leaf spring contacts.

Two principal problems are associated with these switch designs. Firstly, there is a trade off between current handling and small signal capability which results in general purpose designs which compromise both applications. Secondly, the complexity of prior art switch mechanisms usually requires use of external pressure, ratchet or spring mechanisms to hold contact surfaces in the "on" position. These complex mechanisms are expensive to manufacture and prone to failure.

In addition, it is impractical to construct in miniature many conventional switch designs because of the complexity of the component parts which are difficult to economically fabricate in miniature. Many conventional switch designs necessitate assembly techniques not suitable for automated manufacture.

An example of a switch having spring means to hold the contacts in position is shown in Spaeth et al., U.S. Pat. No. 3,546,402, issued Dec. 8, 1970.

SUMMARY OF THE INVENTION

The present invention provides in one aspect a contact assembly for a switch comprising an array of fixed surfaces, which may be posts or abutments, which define three or more points on a periphery. At least two of these surfaces should be contact surfaces. The posts may be arranged in more than one array in any fashion to form a grid or circular pattern. An electrically conductive elastic closed loop is provided, which may be made of a conductive metal. The elastic closed loop is larger than the periphery defined by the fixed contact surfaces, so that when the loop is placed into the array, it is unattachedly seated under stress and bridges at least some of the contact surfaces. At least two of the surfaces are spaced to provide a path for the loop of increased stress as it is moved out of the array between the surfaces.

In another aspect, the invention provides for a contact assembly for a switch, comprising a resiliently deformable loop of conductive material, and a plurality of fixed abutments unattached to the loop, which may be posts, extending perpendicular to the plane of the loop and defining a path of movement for said loop, in passing along which path the loop is stressed, the location of the abutments being such that the stress of the loop as it moves along said path exhibits minima and maxima at defined locations, at least certain of said abutments providing electrical contacts to the loop such as to complete at least one electrical circuit through the loop at at least one defined location corresponding to a stress minimum.

Means are provided for moving the closed loop (hereinafter closed loop or simply loop contact) into and out of the array of fixed contact surfaces to make or break contact with the contact surfaces. The means normally provided would be an actuator or finger inserted into the loop and movable against selected portions of the interior of the loop to direct the loop into and out of the contact array. Normally, the contact surfaces, which may be posts, are fixed on a contact support of a non-conductive material, such as plastic.

One feature of this invention is that the closed loop is under stress within the area defined by the contact surfaces or abutments and the bridging contact may thus provide good electrical conductivity and a minimum of contact "bounce".

Another feature of this invention is that the contact system can be self-aligning, since the loop is most stable within a contact array which allows the switching mechanisms to be designed so that it can remain in the "on" or "off" position without spring-type mechanical biasing components and attachment to the abutments or contact surfaces. The contact surfaces or abutments are arranged so that there are stress minima and maxima at defined locations. There will normally be stress minima at a switch position which it is desired to maintain at a stable "on" or "off" position.

Still another feature of this invention is that the contact system can be self-wiping, which can prevent oxidation of extraneous matter from interferring with the integrity of the switching action. Self-wiping contacts can be capable of switching low-level currents.

BRIEF DESCRIPTION OF THE DRAWINGS

An example of one form of switch in accordance with the invention is shown in the accompanying drawings, wherein:

FIGS. 4A, 4B and 4C are schematic drawings of another arrangement of contact posts, illustrating a rotary switch.

FIGS. 5A, 5B and 5C illustrate another arrangement of contact posts and the movement of the loop contact between such posts.

DESCRIPTION OF A PREFERRED EMBODIMENT

Figure 1:
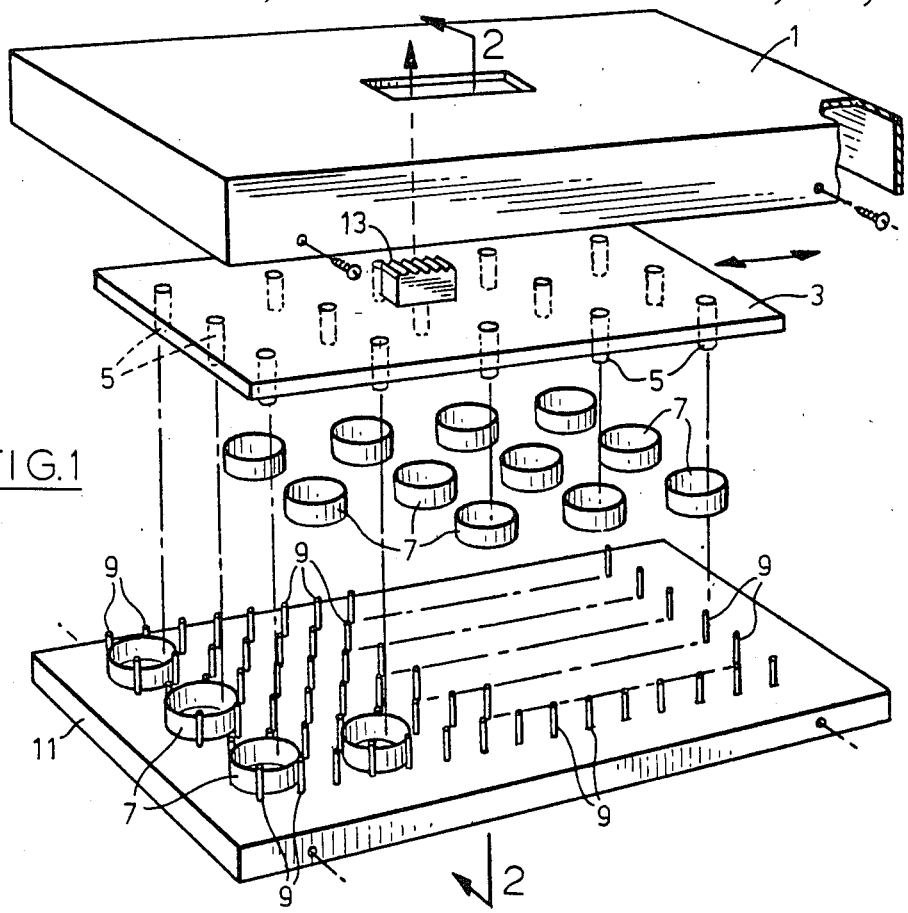
FIG. 1 is an exploded perspective view of one switch made in accordance with this invention.

Referring to the drawings, in particular FIG. 1, a switch is shown comprising a housing 1, an actuator support 3, actuators 5, loop contacts or closed loops 7, contact posts 9 and contact post support 11.

This particular embodiment is designed for circuits such as electronic equipment employing 16 and 32-bit microprocessors where it is desirable to switch multiple parallel low-level circuits at the printed circuit board level. For such an application a dense grid of self-wiping miniature switch elements is desirable. Such elements are not presently available based on current switch designs. For example, the 15 pole switch shown in FIG. 1 can be mounted directly on to a printed circuit board and could occupy less than two square inches of board space, using standard 0.1 inch spacing for posts 9.

The housing 1, the actuator support and actuator 3 and 5 and the post support 11 are preferably made of a suitable non-conductive material such as a thermoplastic polyester. Attached to the actuator support 3 is a knob 13 or other means to move the actuator support 3 and which is also preferably made of a thermoplastic polyester.

The fixed contact posts 9 are preferably made of machined phosphor bronze and the loops are preferably made of beryllium copper. However, it will be appreciated that other suitable contact materials are available including materials which have been plated in gold, silver or cadmium oxide and non-metallic conductive materials.

In the arrangement shown in FIG. 1, the stationary contact posts 9 are arranged in a grid of six posts by fifteen posts. For clarity not all the posts are shown.

Figure 2A:
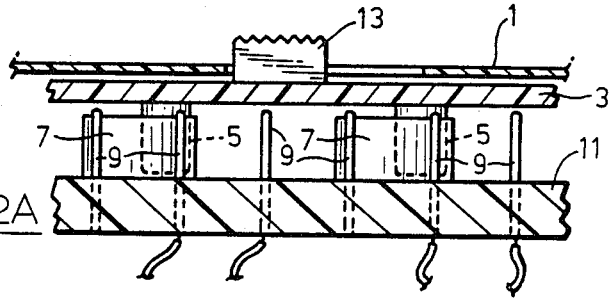
FIG. 2A is a section taken along the lines 2—2 in FIG. 1 and showing the contacts in the first position of FIG. 1
Figure 2B:
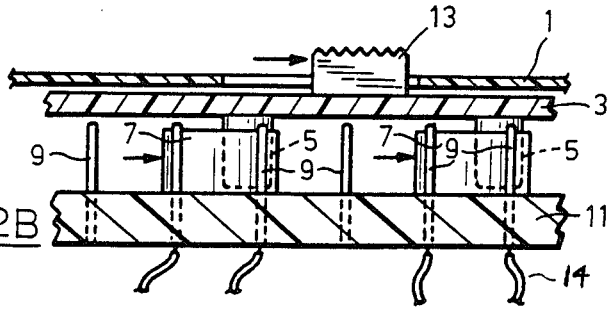
FIG. 2B is the same section after the contacts have been moved in the direction shown by the arrows.

As shown in FIGS. 2A and 2B posts 9 extend through post support 11 and are electrically connected to wires 14 which extend to the appropriate circuits to be switched (not shown).

Figure 3A:
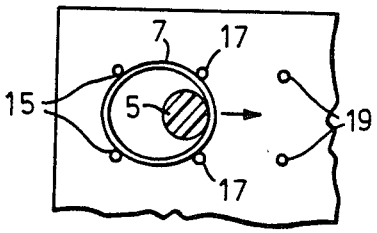
FIGS. 3A, 3B and 3C are schematic plan views of a portion of the switch shown in FIG. 2 illustrating movement of the closed loop from one set of contact posts to another.

It will be seen that the contact posts define a series of points on a periphery which in this case is approximately circular, as best illustrated in FIGS. 3A, B and C. The group of posts numbered 15 and 17 in FIG. 3A define one such set of posts which define points on a periphery. In this patent we have referred to a set of posts which define points on a periphery into which a loop is seated as an "array". The total arrangement of posts we have referred to as a grid. The loop 7 is of a size slightly larger than the periphery defined by these posts. It is inserted under pressure or under stress into the array and will thereby assume a non-circular, usually elliptical shape as shown in FIG. 3A.

It will be appreciated that in this context, periphery does not imply that the arrangement of posts must be circular. As shown in FIG. 6, the arrangement can be such that the posts are arranged on the circumference of an ellipsis as well as the circumference of a circle of any convenient pattern so long as the loop can be stressed and inserted into this pattern and moved as later described.

As shown in FIGS. 1–3 the closed loop contacts 7 are press-fit into the space provided in the array between the stationary contact posts 9.

When seated, the loops 7 in this arrangement act as bridging contacts between the four posts which they contact. For example, in FIG. 3A, the loop 7 is providing contact between posts 15 and 17. Posts 15 and 17 are given common numbers because they are electrically connected.

The loops are made slightly larger than the space between the contact posts, but not so large that they cannot be suitably deformed for insertion under stress into the contact array. Preferably, the elastic limits of the material used are not exceeded so that the loop will be able to deform both when loaded under stress and when moved between posts as will be hereinafter described and yet will be able to resume its shape when seated in a new contact array.

Figure 3B:
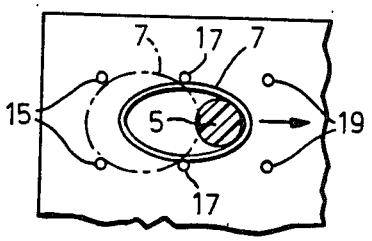
Figure 3C:
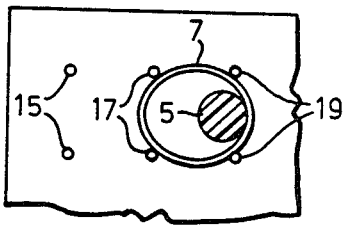

In operation, the knob 13 as shown in FIG. 1 is moved. This moves the actuator support 3 and the actuators 5 in unison. The actuators are placed within the loops 7 as can be seen in Figures 2A and B and 3A, B and C. In FIGS. 2A and 3A, the actuator is abutting the interior surface of the loop in one direction to move the loop between posts 17. FIG. 3B shows the loop in transition between these posts. During this movement, contact posts 17 are wiped by the action of the switch. The loop naturally wants to assume a stable position within points of the periphery defined by the contact array which correspond to stress minima. Continued movement of the actuator rod thus moves the loop to a new stable position between posts 17 and 19 as shown in FIG. 3C.

The loop is under increased stress as it passes between posts 17 and therefore it will want to resume a stable position either between posts 17 and 19 or between posts 15 and 17. The movement of the loop past these posts results in wiping of the contact surface of the loop against the posts which will facilitate the removal of oxidation, dirt and dust and other impurities which might affect the operation of the contact. In operation the knob 13 probably need not be moved the entire travel. Once the loop 7 has passed the posts 17 which correspond to a point of stress maxima it will want to snap into a new stable position. As the loop "snaps" into its new stable formation, there may also be some wiping against contact posts 19 and similarly against contact posts 15 on the return journey.

In the switch shown in FIG. 1, the centre contact posts 17 will be paired electrically and would normally represent the common electrical posts. Contact posts 15 and 19 operate separate circuits so that in one position the loop 7 bridges contact posts 15 and 17 to complete the circuit between posts 15 and 17 and in another position the loop bridges contact posts 17 and 19 to complete that circuit. Contact posts 15, 17 and 19 are paired to provide lower circuit resistance and redundancy. It will be appreciated that in order to provide separate electrical subswitches in the grid of posts shown in FIG. 1, a space is left before the next loop is placed into the grid. Thus each loop is placed at the first, fourth, seventh and every third space thereafter in the direction of movement of the switch 13 as best shown in FIG. 1. However, every other space is sufficient spacing in the other direction, again as best shown in FIG. 1.

Figure 6A:
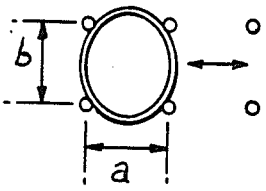
FIG. 6A and 6B (which are on the same page as FIG. 3) are schematic drawings showing alternate post spacing.
Figure 6B:
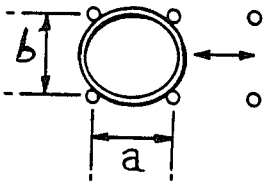

Although the spacing of the contact posts in the array shown in FIG. 1 and FIG. 3 is equal, it is not necessary for this to be so. If the spacing between the posts in both directions is equal, as it is shown in FIG. 3, this will result in a bi-stable elliptical switch for general purpose applications. However, as shown in FIG. 6A if the distance b is greater than the distance a, this will deform the contact so that its main elliptical axis will be at 90° to the movement of travel of the contact as shown by the arrow. This arrangement will provide maximum wiping action for power applications. If the spacing of the contact posts b is less than that of the spacing of posts a as shown in FIG. 6B, this will result in an elliptical axis along the direction of travel of the contact as shown by the arrows in FIG. 6B and will result in a low pressure contact for plated dry circuit applications.

Figures, 4A, 4B and 4C illustrate a contact arrangement to provide a switch with single-pole 6-position make-before-break "Form D" rotary action. In FIG. 4A, the bridging contact loop 25 is seated between the main centre stationary contact post 27 and the fixed contact posts 29. In FIG. 4B, as a rotary actuator is turned clockwise, the bridging contact loop 25 is forced through an unstable position where it makes contact with a single contact from each contact pair 29 and 31 and the main centre stationary contact post 27. At this point, the contact is made with one member of the second pair of contacts 31 while still also in contact with one of the first pair of contacts 29. The movable bridging contact loop 25 is once again self-aligned and stable as shown in FIG. 4C between contact pair 31 and the main centre stationary contact 27. As should be readily apparent, like numbered contacts are electrically paired in this embodiment. Thus, contact posts 33, 35, 37 and 39 are electrically connected.

FIGS. 5A, 5B and 5C illustrate a contact arrangement for double-pole single throw normally open/-closed "Form Z" action. In this arrangement, there are two sets of contact pairs which are bridged alternately as the switch is activated. FIG. 5A shows the movable bridging contact loop 41 seated and stable between contact pairs 43 and 45. The bridging contact loop 41 is unstable and in transition in FIG. 5B. Contact pairs 47 and 49 are bridged by the stable and self-aligned movable contact loop 41 in FIG. 5C.

The contact arrangements described above and shown in FIGS. 3, 4, 5 and 6 are illustrative of possible embodiments of this invention. However, it is possible to design a switch embodying this invention which would operate in almost any of the conventional ways used in switch design. Thus, it is possible to have almost any variety of switch action by changing the arrangement of the posts and the wiring to the connections.

Although the switch construction described above is probably most useful in the design of miniature switches, its simplicity and compact design can be used in switches of any size.

In addition the electrical contacts described employ arrays of contact posts, and the switches themselves made from such arrays may be ganged together using gears or other suitable mechanical contrivances to produce more complicated switches.

I claim:

1. A contact assembly for a switch, comprising a resiliently deformable loop of conductive material, and a plurality of fixed abutments unattached to the loop extending perpendicular to the plane of the loop and defining a path of movement for the loop, in passing along which path the loop is stressed by passing between at least two abutments, the location of the abutments being such that the stress of the loop as it moves along the path exhibits minima and maxima at defined locations, at least certain of the abutments providing electrical contacts to the loop such as to complete at least one electrical circuit through the loop at at least one defined location corresponding to a stress minimum, and in which the stress maxima is defined by at least two abutments.

2. A contact assembly as in claim 1 in which the circuit is interrupted at at least one other defined location corresponding to a stress minimum.

3. A contact assembly according to claim 2, comprising a plurality of the deformable loops, spaced in a common plane, and wherein the abutments are arranged in a grid defining a plurality of paths for said loops.

4. A contact assembly according to claim 3, wherein the paths are parallel, and actuating means are unattachedly provided engaging the loops to move them conjointly along the paths.

5. A contact assembly according to claim 8, wherein at least one of the paths contains more than one loop.

6. A contact assembly according to claim 1, comprising a plurality of the deformable loops spaced along the path and wherein the path is elongated and has a sufficient number of locations along the path corresponding to stress minima that each loop when in such a location is separated from an adjacent loop by at least one other such location, the assembly further including actuator means unattachedly engageable with the loops to move them along the path whilst maintaining their separation.

7. A contact assembly for a switch comprising:

(a) an electrically conductive elastic closed loop, (b) an array of at least three fixed surfaces, at least two of which are contact surfaces, which are mounted in fixed relation to each other on a support means on a periphery smaller than the periphery of the loop and which unattachedly confine the loop under stress within the array so that the loop bridges the contact surfaces, (c) in which at least two of the surfaces are spaced to provide a path for the loop of increased stress as it is moved out of the array.

(d) means for moving the loop along the path into and out of the array to make or break contact with at least one of the contact surfaces.

8. A contact assembly as claimed in claim 7 in which additional fixed surfaces, at least one of which is a contact surface, are arranged in a further array adjacent to the first array and which together with some of the fixed surfaces of the first array define at least three points on a periphery smaller than the periphery of the loop and the closed loop is moved into and out of this additional array to make or break contact with the additional contact surfaces.

9. A contact assembly as claimed in claim 8 in which the electrically conductive loop is only slightly larger than the periphery defined by the fixed contact surfaces and within the elastic lmits of the material used for the loop when the loop is seated and moved into and out of the contact array.

10. A contact assembly as claimed in claim 9 in which the electrically conductive closed loop is endless and normally circular in its unstressed condition.

11. A contact assembly as claimed in claim 10 in which the fixed surfaces are posts arranged as points substantially on a circumference.

12. A contact assembly as claimed in claim 11 in which the posts and closed loop are of a conductive metal and the support means is a non-conductive plastic board.

13. A contact assembly as claimed in claim 9 in which the means for moving the closed loop comprise an actuator inserted within the loop and movable against selected portions of the interior of the loop to direct the loop into and out of the contact array.

14. A contact assembly as claimed in claim 13 in which the actuator is a rod.

15. A contact assembly as claimed in claim 9 in which the closed loop wipes against the fixed contact surfaces when the loop is seated and moved into and out of the contact array.

16. A switch comprising:

(a) a housing means, (b) a non-conductive support within the housing means, (c) a plurality of electrically conductive contact posts arranged in a rectangular grid on the non-conductive support to create a series of spaces on the support defined by at least four posts, (d) a plurality of electrically conductive resilient substantially circular endless closed loops slightly larger than the spaces defined by the conductive posts and unattachedly seated under stress within the spaces at intervals not closer than every third space in a first direction and at every other space in a second direction, (e) a plurality of actuators rigidly connected together and each inserted into a loop and movable together against selected portions of the interior of the loops to direct the loops together under stress between at least two intermediate posts to adjacent spaces in the grid in a first direction to thereby break contact with a first pair of contact posts which are electrically paired to turn off a first circuit and to make contact with a second pair of contact posts which are electrically paired to turn on a second circuit while maintaining contact with at least two contact posts which are intermediate between the first and second pair of contact posts and which are electrically common to both the first and second circuit.

17. A contact assembly for a switch comprising:

(a) a plurality of fixed contact posts mounted in fixed relation on a non-conductive support, (b) the contact posts creating a plurality of arrays in a predetermined path, each array defining three or more points substantially on the circumference of a circle, (c) a plurality of electrically conductive circular elastic closed loops slightly larger than the circles defined by the posts, (d) the loops unattachedly seated under the stress in some of the arrays to electrically connect the posts of those arrays.

(e) a plurality of actuator rods mounted in fixed relation to each other on an actuator support, the rods being inserted within the interior of the loops and movable in unison against selected portions of the interior of the loops to direct the loops in unison under stress in a predetermined path between two posts out of the array in which they are seated into a neighbouring array to make or break a plurality of circuits at once.

* * * * *